US011713558B2

(12) United States Patent
Inaoka et al.

(10) Patent No.: US 11,713,558 B2
(45) Date of Patent: Aug. 1, 2023

(54) WORK VEHICLE

(71) Applicant: Kubota Corporation, Osaka (JP)

(72) Inventors: Masaki Inaoka, Sakai (JP); Yoshihiro Ebata, Sakai (JP); Shun Tsuruta, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 303 days.

(21) Appl. No.: 17/209,238

(22) Filed: Mar. 23, 2021

(65) Prior Publication Data

US 2022/0034063 A1 Feb. 3, 2022

(30) Foreign Application Priority Data

Aug. 3, 2020 (JP) ..... 2020-131698

(51) Int. Cl.
*E02F 9/22* (2006.01)
*E02F 9/08* (2006.01)
*E02F 9/16* (2006.01)

(52) U.S. Cl.
CPC ..... *E02F 9/0808* (2013.01); *E02F 9/0833* (2013.01); *E02F 9/166* (2013.01); *E02F 9/2275* (2013.01)

(58) Field of Classification Search
CPC ..... E02F 9/0808; E02F 9/0833; E02F 9/166; E02F 9/2275
See application file for complete search history.

(56) References Cited

U.S. PATENT DOCUMENTS 3,882,886 A * 5/1975 Ely ..... F16L 3/015 280/421
4,156,487 A * 5/1979 Dowd ..... E02F 3/36 138/110
6,543,563 B1 4/2003 Muraro
8,246,286 B2 * 8/2012 Fukudome ..... E02F 3/382 414/724
8,821,104 B2 * 9/2014 Yasuda ..... E02F 9/0816 414/722
9,534,352 B2 * 1/2017 Kusama ..... E02F 3/38
9,617,706 B2 * 4/2017 Takemura ..... E02F 3/3414
10,465,358 B2 * 11/2019 Takemura ..... E02F 3/34
10,626,895 B2 * 4/2020 Tsuji ..... E02F 9/2275
(Continued)

FOREIGN PATENT DOCUMENTS

EP 3683363 A1 * 7/2020 ..... E02F 9/00
JP 4108912 B2 4/2002
(Continued)

*Primary Examiner* — Barry Gooden, Jr.
(74) *Attorney, Agent, or Firm* — Mori & Ward, LLP

(57) ABSTRACT

A work vehicle includes a vehicle body frame, a cab frame attached to the vehicle body frame so as to be rotatable around a pivot axis, a support provided on the cab frame, a fastener provided on the cab frame and between the support and the pivot axis in a radial direction from the pivot axis, a hydraulic hose, and a hose installation member. The hose installation member includes an engaging portion connected to the fastener, an extending portion configured to be supported on the support, a beam portion connecting the engaging portion and the extending portion, and a first hose holding member provided on the beam portion and having a first opening through which the hydraulic hose passes.

20 Claims, 11 Drawing Sheets

(56) References Cited

U.S. PATENT DOCUMENTS

| | | | | |
|---|---|---|---|---|
| 2015/0132095 | A1* | 5/2015 | Takemura | E02F 9/2275 414/722 |
| 2016/0060840 | A1* | 3/2016 | Iwamoto | E02F 9/18 414/687 |
| 2016/0281325 | A1* | 9/2016 | Miyata | E02F 9/02 |
| 2019/0242093 | A1* | 8/2019 | Handel | E02F 3/3414 |
| 2020/0271143 | A1* | 8/2020 | Binstock | E02F 9/2267 |
| 2021/0114451 | A1* | 4/2021 | Yamamoto | E02F 9/0891 |
| 2021/0254311 | A1* | 8/2021 | Ishii | E02F 9/0858 |
| 2021/0262193 | A1* | 8/2021 | Harada | B60B 35/1054 |
| 2022/0034063 | A1* | 2/2022 | Inaoka | E02F 9/166 |
| 2022/0333351 | A1* | 10/2022 | Kidani | E02F 3/965 |
| 2022/0349152 | A1* | 11/2022 | Okura | F16L 3/221 |
| 2023/0017880 | A1* | 1/2023 | Zander | F16L 3/26 |
| 2023/0060330 | A1* | 3/2023 | Ichihara | E02F 3/325 |

FOREIGN PATENT DOCUMENTS

| | | | | |
|---|---|---|---|---|
| JP | 5058885 | B2 | 12/2009 | |
| JP | 5314177 | | 10/2012 | |
| JP | 6300694 | B2 | 5/2016 | |
| WO | WO-2019054021 | A1 * | 3/2019 | E02F 9/00 |
| WO | WO-2020004327 | A1 * | 1/2020 | B60K 11/04 |

* cited by examiner

WORK VEHICLE

CROSS-REFERENCE TO RELATED APPLICATIONS

The present application claims priority under 35 U.S.C. § 119 to Japanese Patent Application No. 2020-131698, filed Aug. 3, 2020. The contents of this application are incorporated herein by reference in their entirety.

BACKGROUND

Field of the Invention

The present invention relates to a work vehicle.

Discussion of the Background

JP Patent No. 5314177 shows a structure in which a pilot hose for connecting an operation lever in a cabin and a hydraulic actuator is connected via a relay member in a work vehicle in which the cabin is freely opened and closed.

SUMMARY OF THE INVENTION

According to one aspect of the present disclosure, a work vehicle includes a vehicle body frame, a cab frame attached to the vehicle body frame so as to be rotatable around a pivot axis, a support provided on the cab frame, a fastener provided on the cab frame and between the support and the pivot axis in a radial direction from the pivot axis, a hydraulic hose, and a hose installation member. The hose installation member includes an engaging portion connected to the fastener, an extending portion configured to be supported on the support, a beam portion connecting the engaging portion and the extending portion, and a first hose holding member provided on the beam portion and having a first opening through which the hydraulic hose passes.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
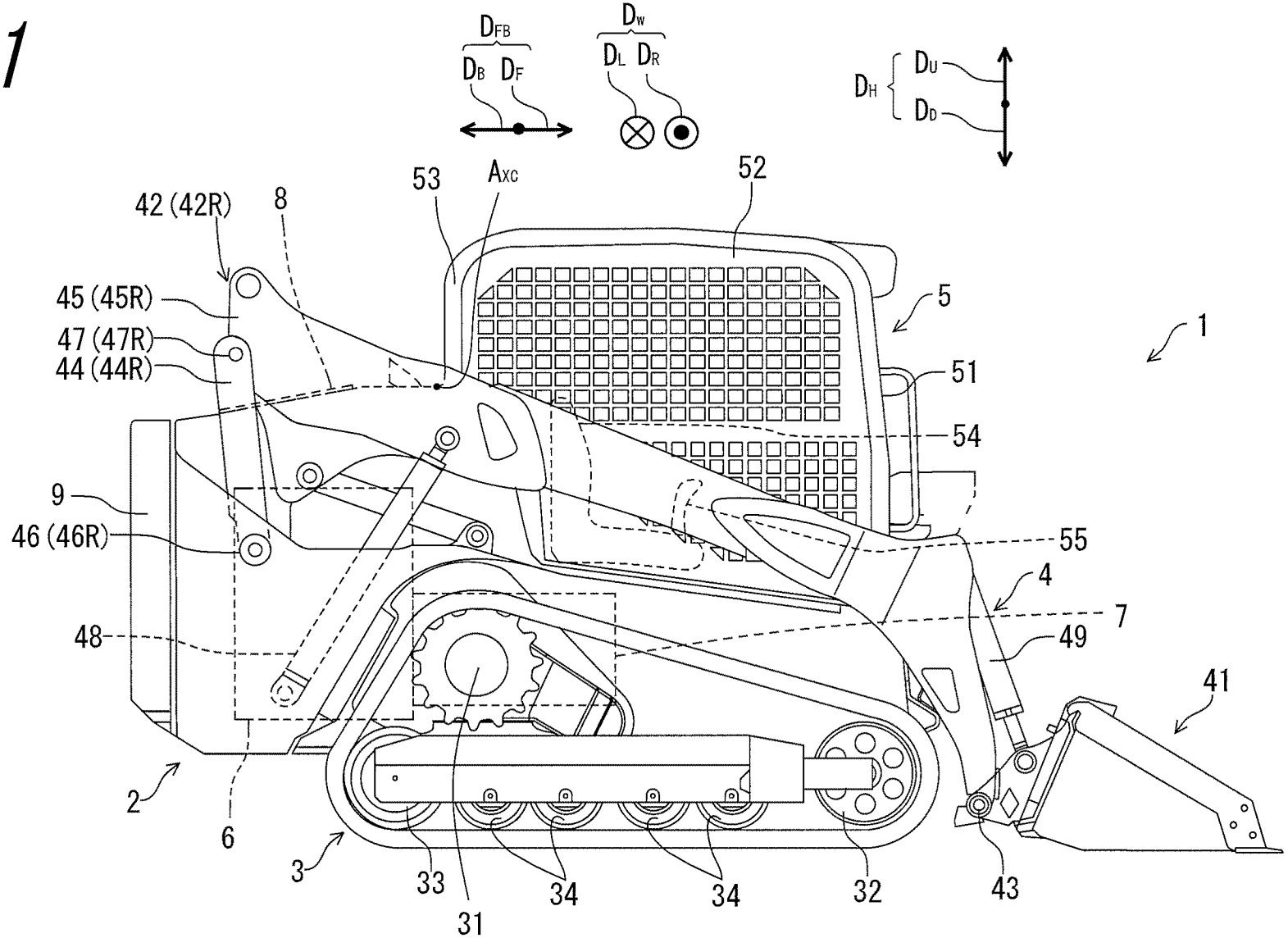
FIG. 1 is a side view of a work vehicle.

The embodiments will now be described with reference to the accompanying drawings, wherein like reference numerals designate corresponding or identical elements throughout the various drawings.

Hereinafter, the present invention will be specifically described with reference to the drawings showing embodiments thereof. In the drawings, like reference numerals denote corresponding or substantially identical configurations.

Embodiment

<Overall Composition>

Figure 2:
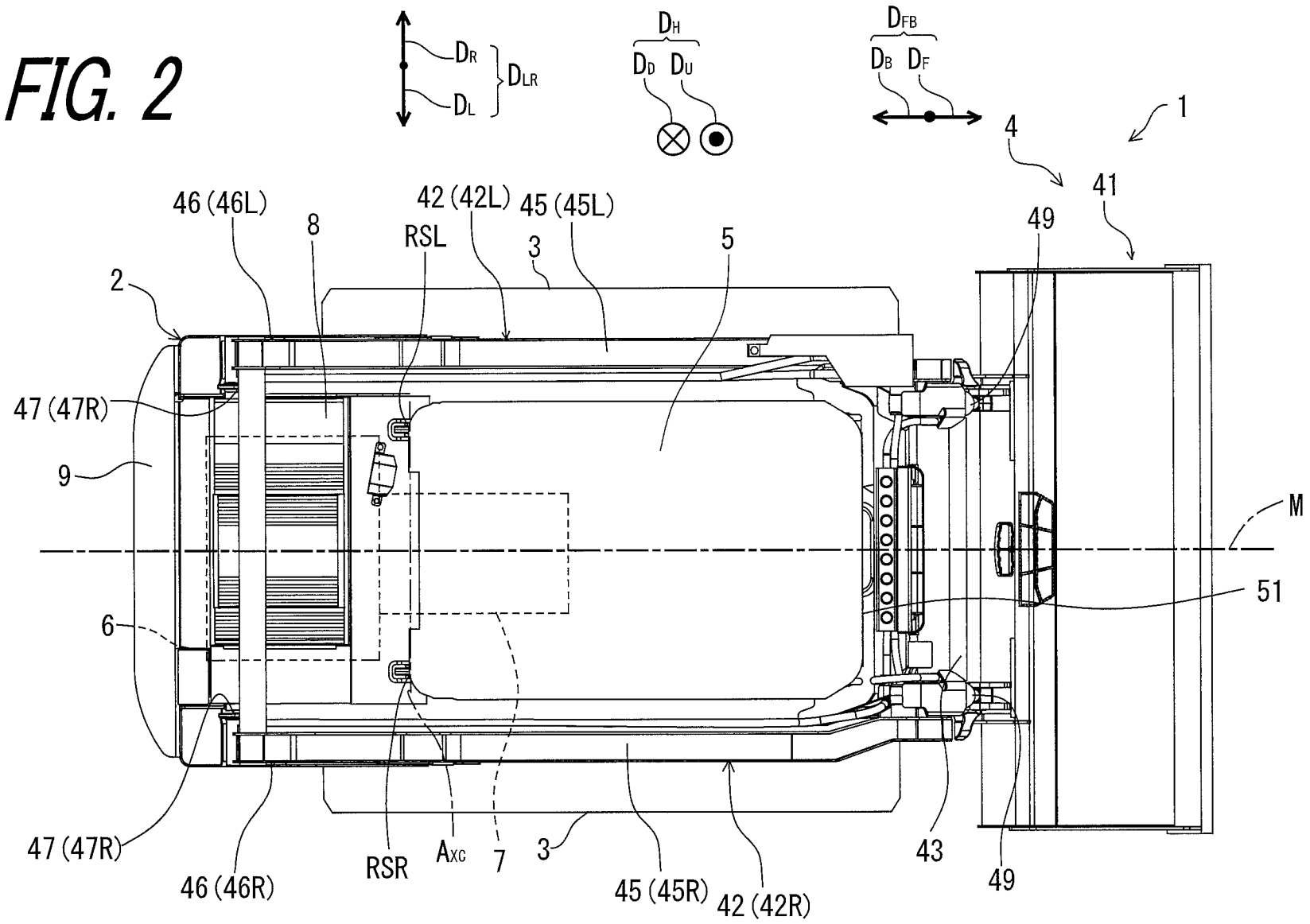
FIG. 2 is a top view of a work vehicle.

Referring to FIGS. 1 and 2, a work vehicle 1, such as a compact track loader, includes a vehicle body frame 2, a traveling device 3, a working device 4, and a cabin 5. The vehicle body frame 2 supports the traveling device 3, the working device 4, and the cabin 5. In the illustrated embodiment, the traveling device 3 is a crawler type traveling device. Therefore, the traveling device 3 includes a drive wheel 31, driven wheels 32 and 33, and a roller 34. However, the traveling device 3 is not limited to a crawler type traveling device. The traveling device 3 may be, for example, a front-wheel/rear-wheel traveling device or a traveling device having a front wheel and a rear crawler. The working device 4 includes a work implement (bucket) 41 at the distal end of the working device 4. The base end of the working device 4 is attached to the rear part of the vehicle body frame 2. The working device 4 includes a pair of arm mechanisms 42 for rotatably supporting the bucket 41 through a bucket pivot shaft 43. Each of the pair of arm mechanisms 42 includes a link 44 and an arm 45.

The link 44 is rotatable about the fulcrum shaft 46 relative to the vehicle body frame 2. The arm 45 is rotatable about the joint shaft 47 relative to the link 44. The working device 4 further includes a plurality of arm cylinders 48 and at least one equipment cylinder 49. Each of the plurality of arm cylinders 48 is rotatably connected to the vehicle body frame 2 and the arm 45, and moves the link 44 and the arm 45 to raise and lower the bucket 41. At least one equipment cylinder 49 is configured to tilt the bucket 41. The cabin 5 is attached to the front part of the vehicle body frame 2. A work vehicle 1 is provided with a front window 51 and an exterior cover 52 on the front and side of a cabin 5, respectively, and the cabin 5 is defined by a cab frame 53. A work vehicle 1 includes a driver's seat 54 and an operation lever 55 in the cabin 5. As shown in FIG. 2, the cab frame 53 is rotatable about the rotational shafts RSL and RSR on the vehicle body frame 2. FIGS. 1 and 2 illustrate a common pivot axis $A_{XC}$ defined by the rotational shafts RSL and RSR. That is, the cab frame 53 is attached to the vehicle body frame 2 so as to be rotatable about the pivot axis $A_{XC}$.

In the embodiment according to the present application, the front-rear direction $D_{FB}$ (forward $D_F$/backward $D_B$) means the front-rear direction (forward/backward) as viewed from an operator sitting on the driver's seat 54 of the cabin 5. The leftward direction $D_L$, the rightward direction $D_R$, and the width direction $D_W$ mean the leftward direction, the rightward direction, and the leftward and rightward direction, respectively, as viewed from the operator. The upward direction $D_U$, the downward direction $D_D$, and the height direction $D_H$ mean the upward direction, the downward direction, and the height direction when viewed from the operator. The front-rear/left-right (width)/up-down (height) directions of the work vehicle 1 correspond to the front-rear/left-right (width)/up-down (height) directions viewed from the operator.

FIG. 1 shows the right side of the work vehicle 1. As shown in FIG. 2, the vehicle body frame 2 is generally symmetrical with respect to the vehicle body center plane M, and of the pair of arm mechanisms 42, the arm mechanism 42 provided on the right side with respect to the vehicle body center plane M is shown as a first arm mechanism 42R, and the arm mechanism 42 provided on the left side with respect to the vehicle body center plane M is shown as a second arm mechanism 42L. A link 44 provided on the right side of the vehicle body center plane M is shown as a first link 44R. An arm 45 provided on the right side of the vehicle body center plane M is shown as a first arm 45R, and an arm 45 provided on the left side of the vehicle body center plane M is shown as a second atm 45L. A fulcrum shaft 46 provided on the right side with respect to the vehicle body center plane M is shown as a first fulcrum shaft 46R, and a fulcrum shaft 46 provided on the left side with respect to the vehicle body center plane M is shown as a second fulcrum shaft 46L. A joint shaft 47 provided on the right side of the vehicle body center plane M is shown as a first joint shaft 47R, and a joint shaft 47 provided on the left side of the vehicle body center plane M is shown as a second joint shaft 47L.

Referring to FIGS. 1 and 2, the work vehicle 1 further includes an engine 6 provided at the rear of the vehicle body frame 2 and a hydraulic pump 7. The engine 6 drives the hydraulic pump 7. The hydraulic pump 7 is configured to discharge hydraulic oil for driving a hydraulic actuator (a plurality of arm cylinders 48, at least one equipment cylinder 49, a hydraulic motor for driving drive wheels 31, and the like) connected to the traveling device 3 and the working device 4. The engine 6 is provided between the pair of arm mechanisms 42 in the width direction $D_W$ of the work vehicle 1. The work vehicle 1 further includes a cover 8 for covering the engine 6. The work vehicle 1 further includes a bonnet cover 9 provided at the rear end of the vehicle body frame 2. The bonnet cover 9 can be opened and closed, and a maintenance worker can perform maintenance work of the engine 6 or the like.

Figure 3:
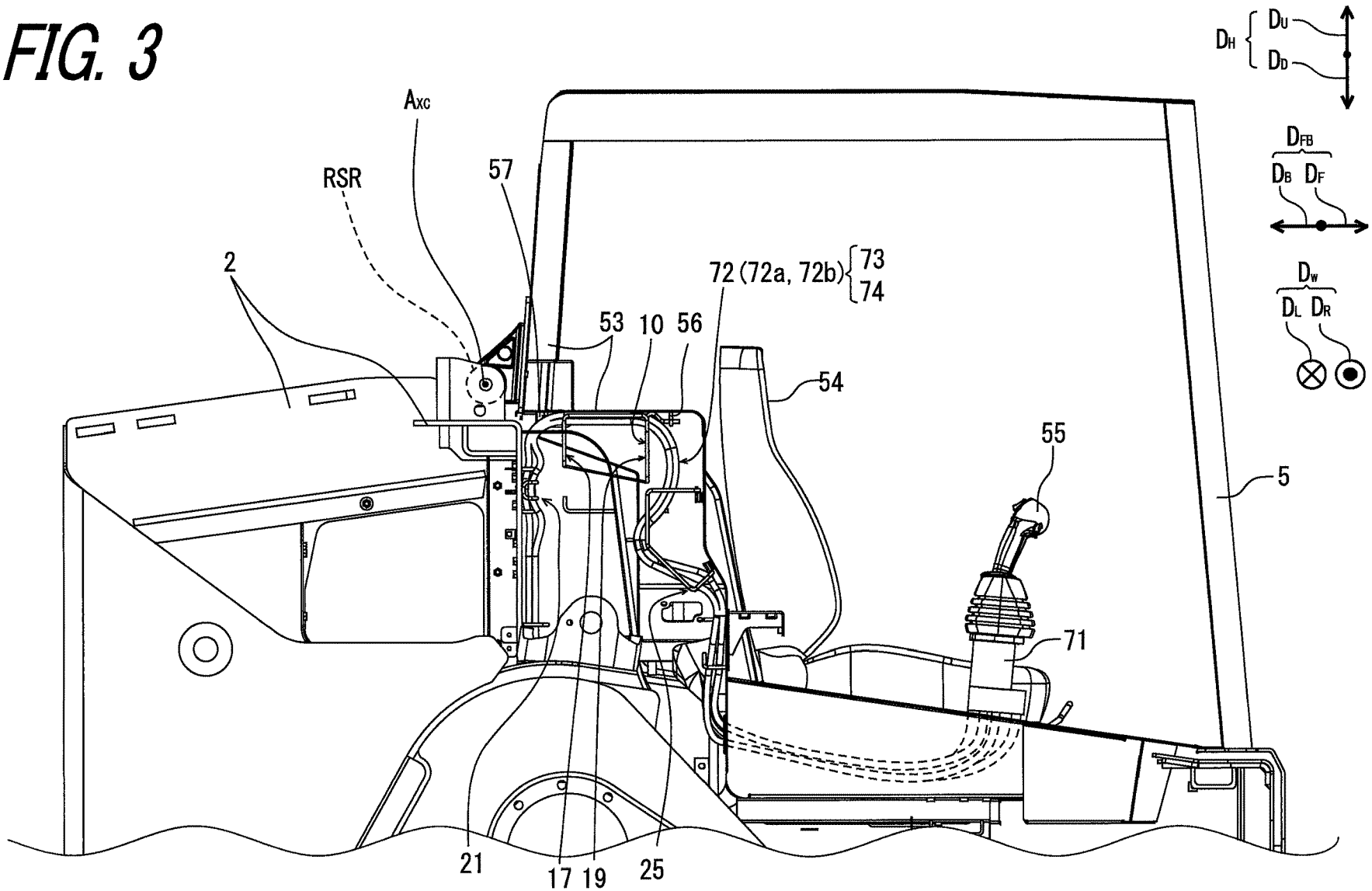
FIG. 3 is a side view of the work vehicle when the exterior cover of the cabin is removed.

FIG. 3 is a side view when the exterior cover 52 of the cabin 5 of the work vehicle 1 is removed in FIG. 1. In FIG. 3, in addition to the exterior cover 52, the pair of arm mechanisms 42 and a part of the vehicle body frame 2 are not shown. Referring to FIG. 3, the work vehicle 1 includes a hydraulic control valve 71 operated by an operation lever 55 and a plurality of hydraulic hoses 72 connected to the hydraulic control valve 71. The plurality of hydraulic hoses 72 include a first hydraulic hose 73 connecting the hydraulic pump 7 and the hydraulic control valve 71, and a second hydraulic hose 74 connecting a hydraulic actuator (a plurality of arm cylinders 48, at least one equipment cylinder 49, a hydraulic pump for driving drive wheels 31, and the like) and the hydraulic control valve 71. Specifically, the hydraulic actuator includes a plurality of arm cylinders 48 and at least one equipment cylinder 49. In the following embodiments, one of the plurality of hydraulic hoses 72 may be a hydraulic hose 72*a* and the rest may be a plurality of additional hydraulic hoses 72*b*.

Figure 4:
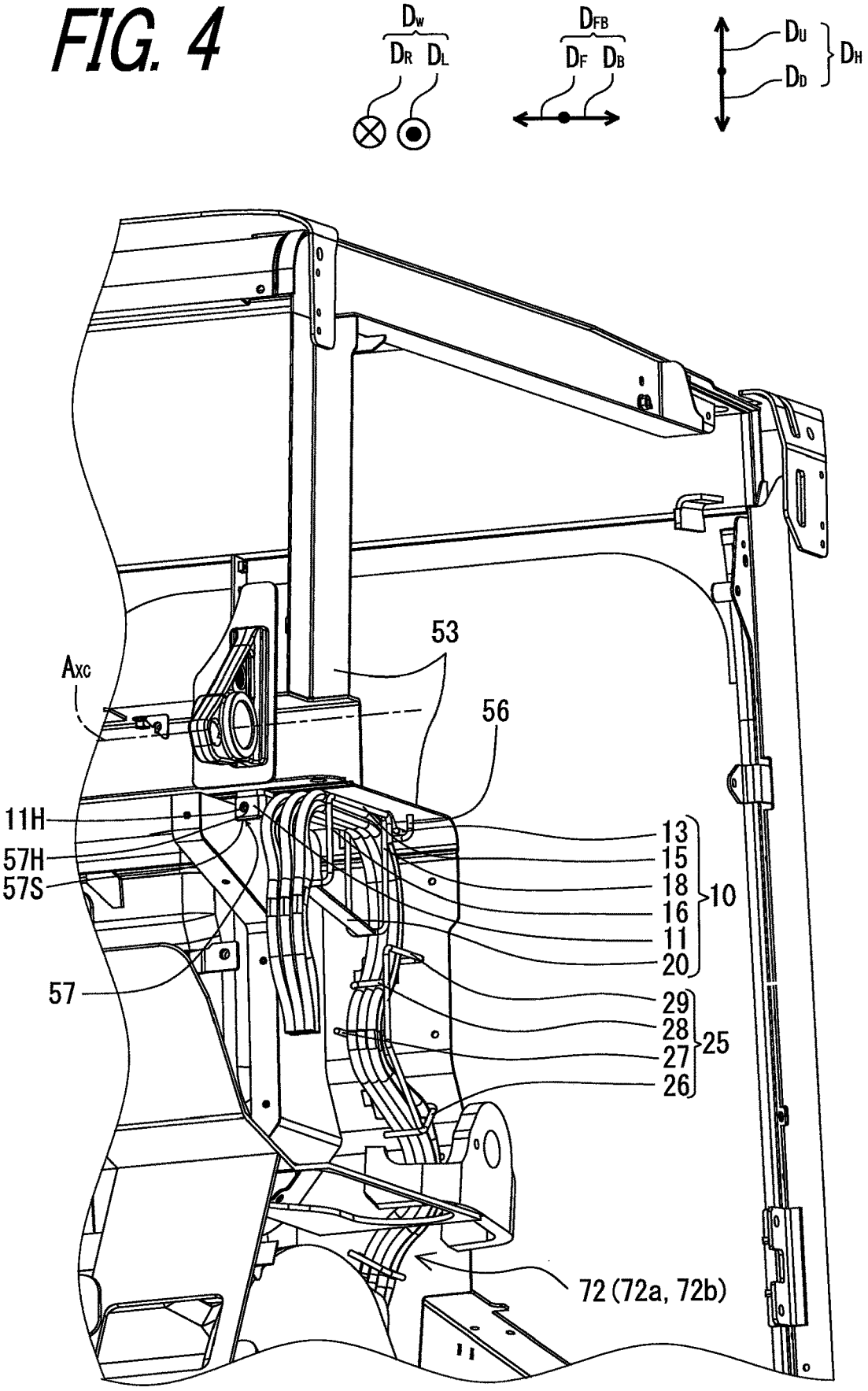
FIG. 4 is an enlarged perspective view of the vicinity of the hose installation member.
Figure 5:
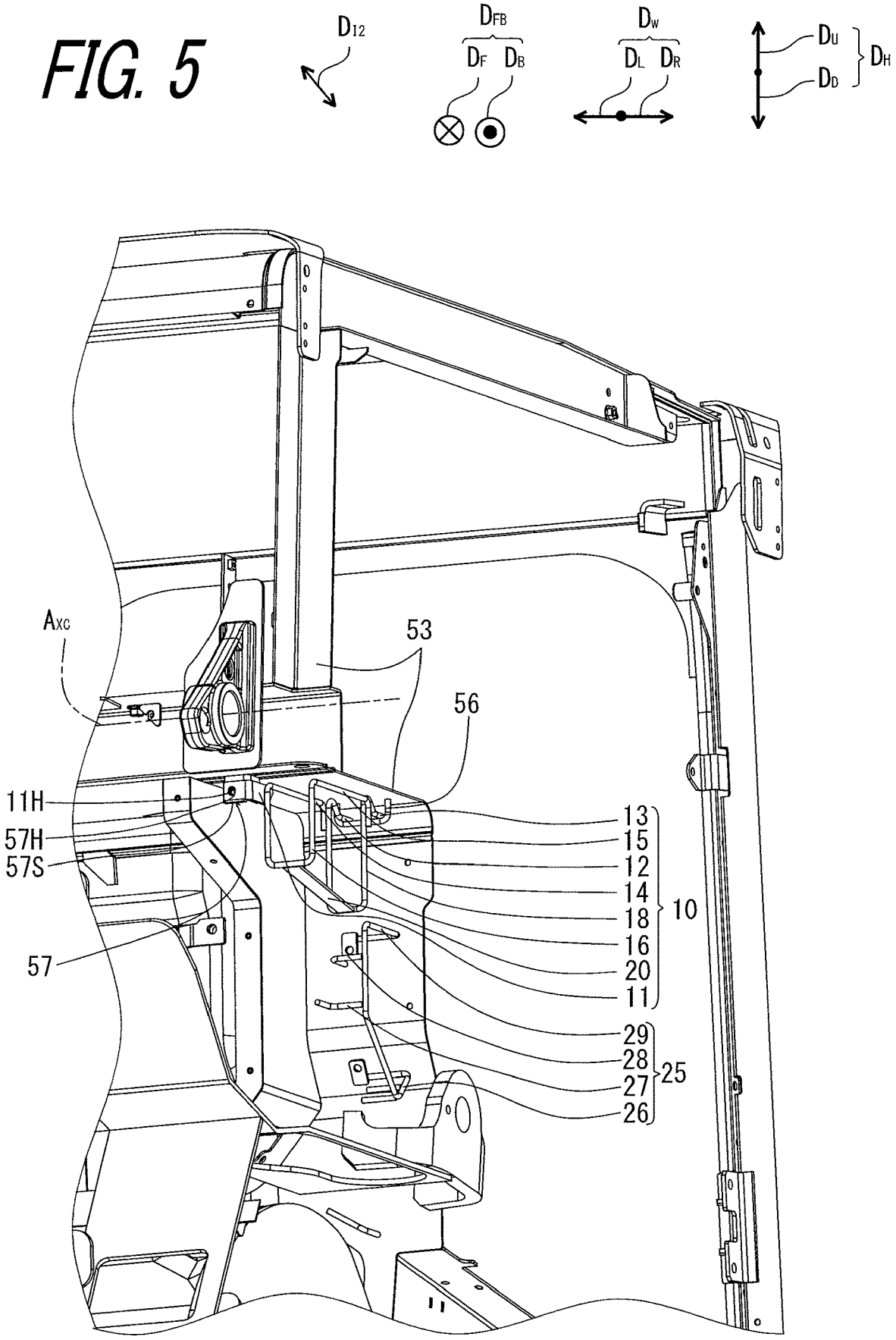
FIG. 5 is a view in which a plurality of hydraulic hoses are removed in FIG. 4.
Figure 6:
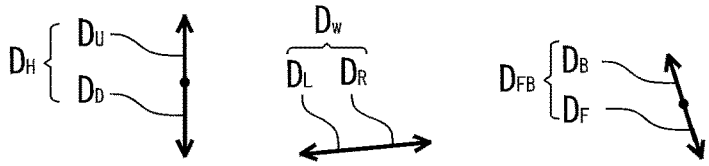
FIG. 6 is a view in which the hose installation member 10 is removed in FIG. 5.
Figure 6:
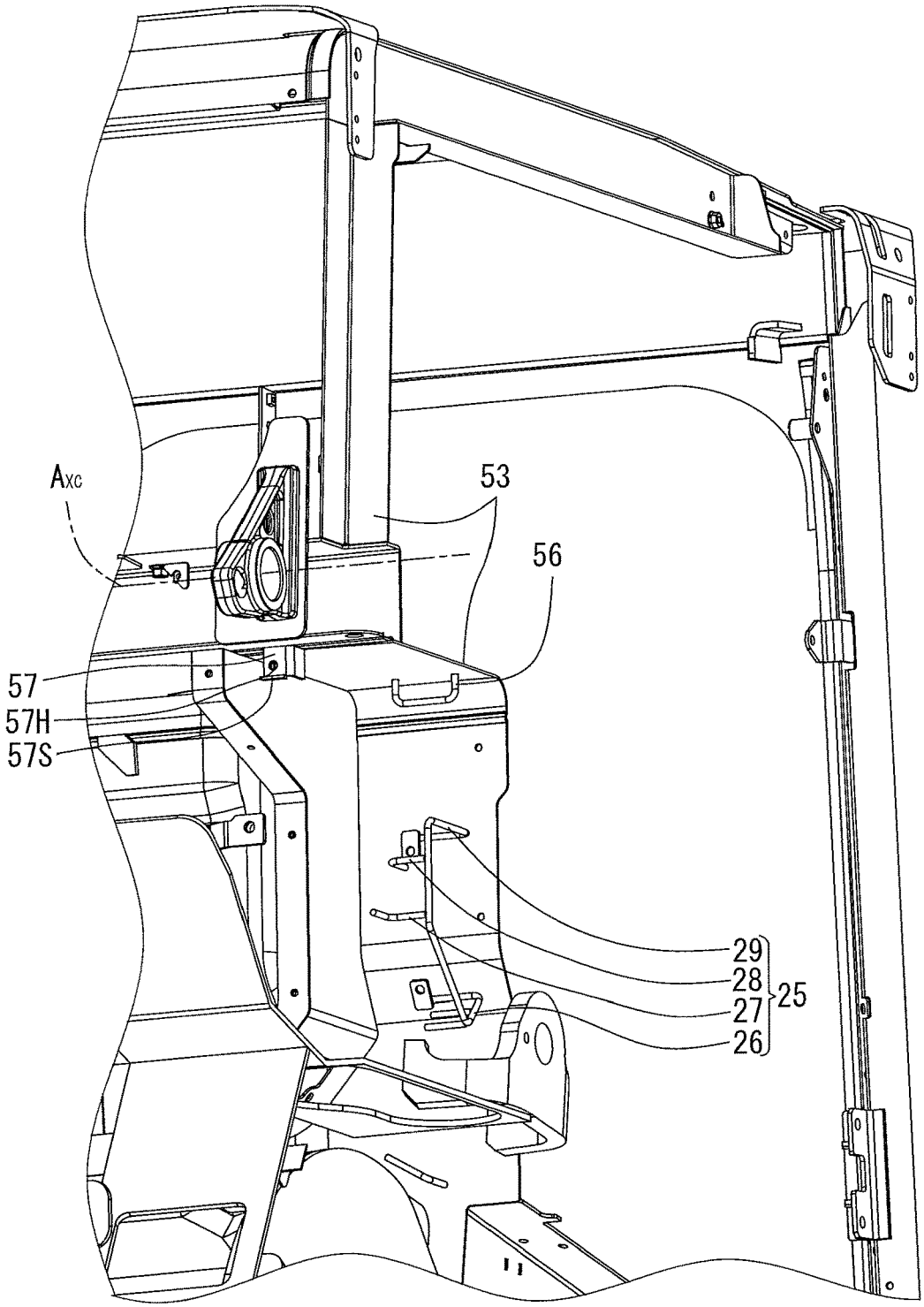

The work vehicle 1 further includes a hose installation member 10 for installing a plurality of hydraulic hoses 72. FIG. 4 is an enlarged perspective view of the vicinity of the hose installation member 10. FIG. 5 is a view in which a plurality of hydraulic hoses 72 are removed in FIG. 4. FIG. 6 is a view in which the hose installation member 10 is removed in FIG. 5. Referring to FIGS. 3 and 6, the work vehicle 1 includes a support 56 and a fastener 57 provided on cab frame 53. The support 56 is a U-shaped hook. The fastener 57 is provided between the support 56 and the pivot axis $A_{XC}$ with respect to a radial direction (e.g., front-rear direction $D_{FB}$) about the pivot axis $A_{XC}$. The support 56 and the fastener 57 are welded to the cab frame 53.

Figure 7:
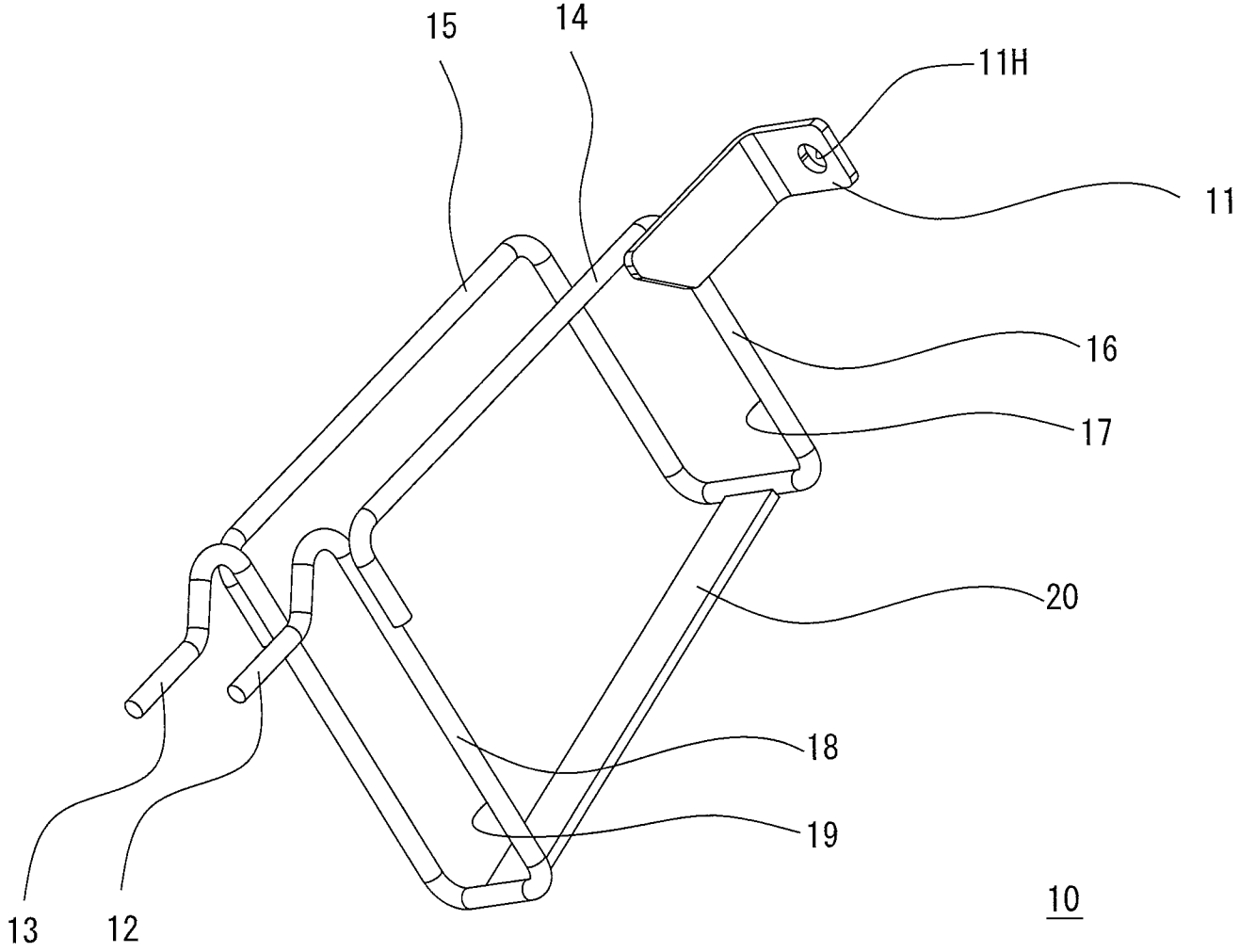
FIG. 7 is an enlarged perspective view of the hose installation member.
Figure 8:
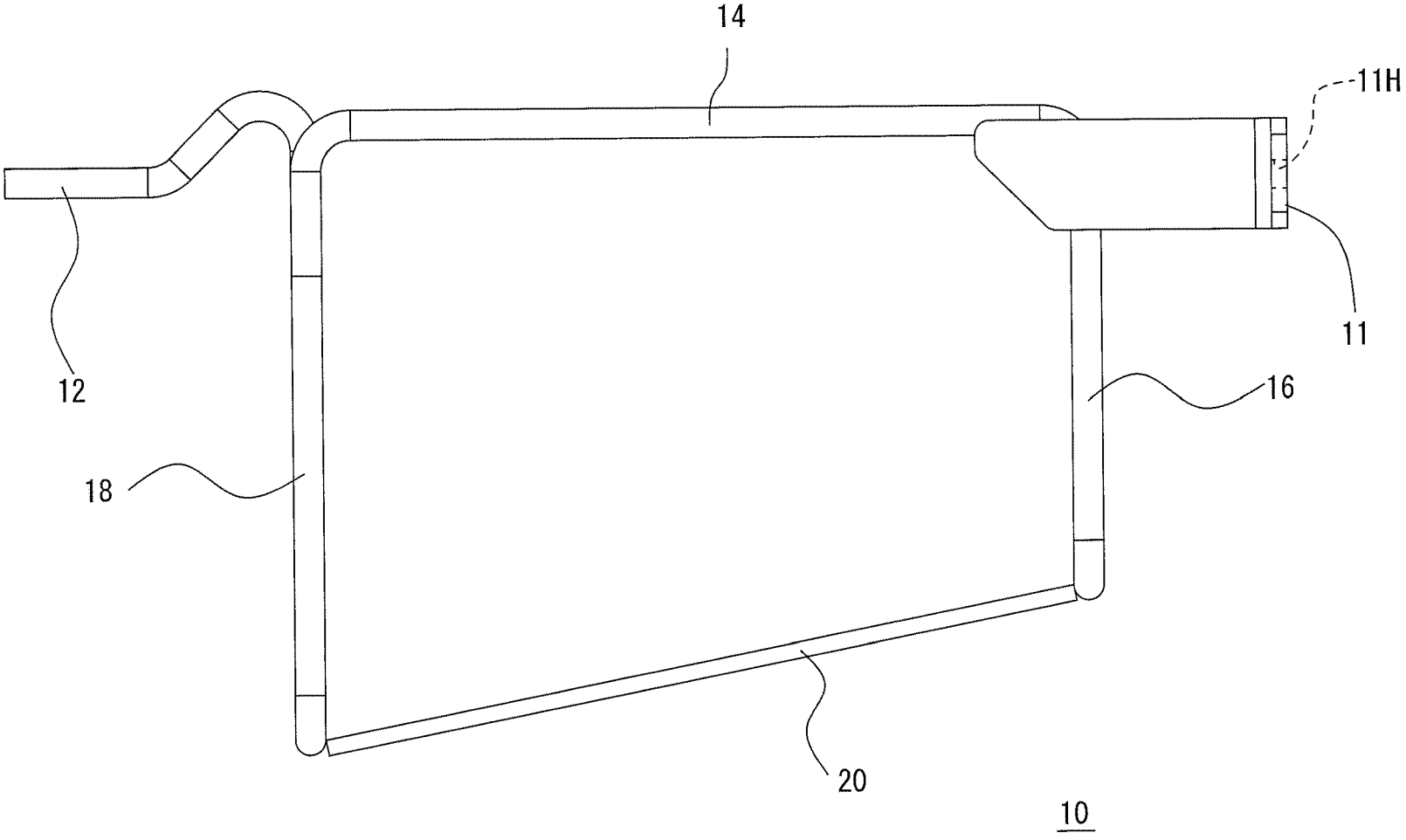
FIG. 8 is a side view of the hose installation member.
Figure 9:
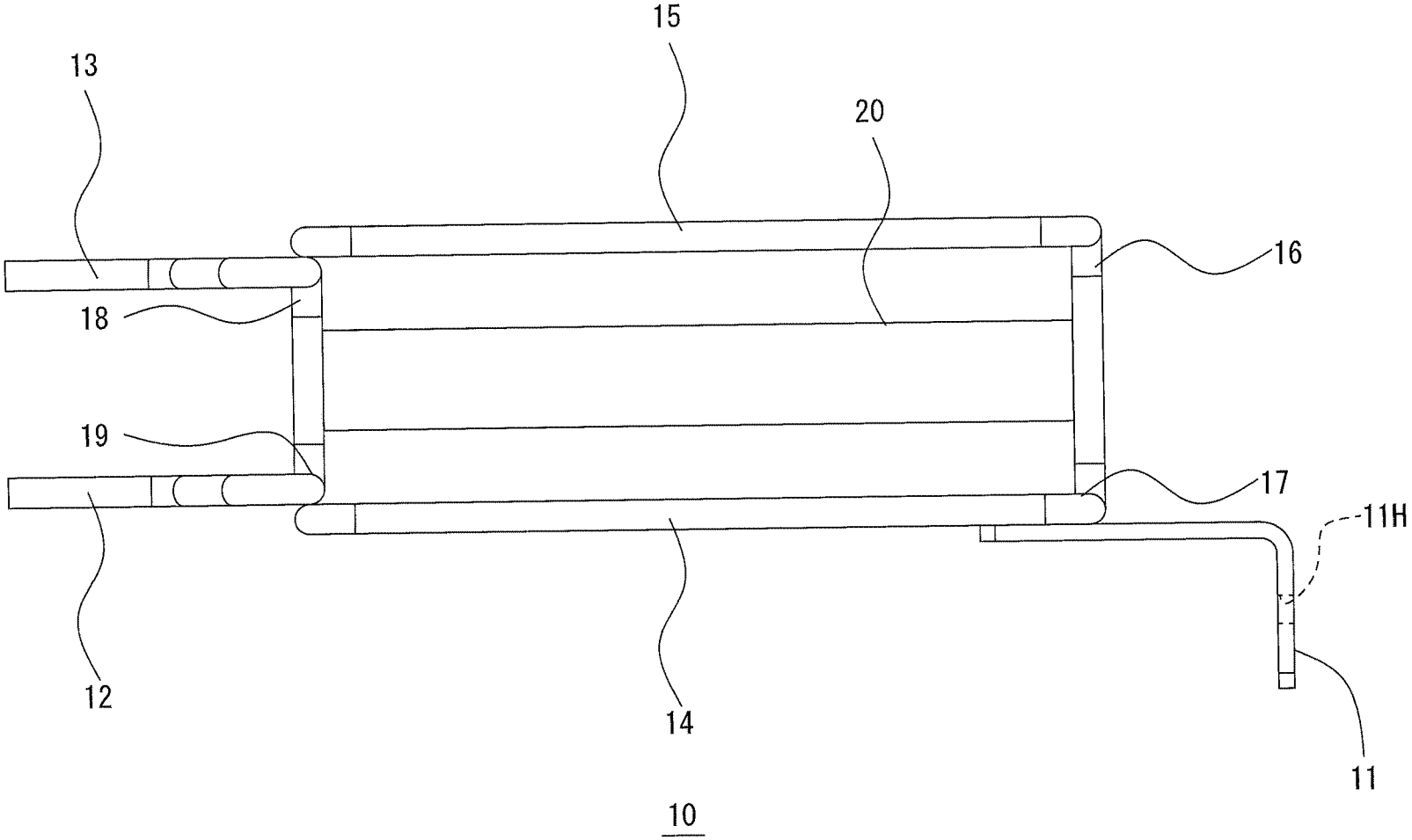
FIG. 9 is a top view of the hose installation member.

FIG. 7 is an enlarged perspective view of the hose installation member 10. FIG. 8 is a side view of the hose installation member 10. FIG. 9 is a top view of the hose installation member 10. Referring to FIGS. 3-5 and 7-9, the hose installation member 10 includes an engaging portion 11, an extending portion 12, an additional extending portion 13, a beam portion 14, a first additional beam portion 15, a first hose holding member 16, a second hose holding member 18, and a second additional beam portion 20. The engaging portion 11 is attachable to and detachable from the fastener 57. The engaging portion 11 is formed of an L-shaped plate-like member. The engaging portion 11 has a through hole 11H through which a bolt (not shown) passes.

As shown in FIGS. 4 to 6, the fastener 57 has a bolt hole 57H for bolting the engaging portion 11. A bolt inserted into the bolt hole 57H is not shown. As shown in FIGS. 4 and 5, when the engaging portion 11 is attached to the fastener 57, the through hole 11H is positioned coaxially with the bolt hole 57H. The fastener 57 further has a stay 57S for hooking the engaging portion 11. When the engaging portion 11 is attached to the fastener 57, the engaging portion 11 can be fastened to the fastener 57 by hooking the engaging portion 11 to the stay 57S and screwing a bolt into the bolt hole 57H. Since the engaging portion 11 is fastened to the fastener 57 with the bolt, the hose installation member 10 is prevented from coming off from the support 56 and the fastener 57 by the vibration of the work vehicle 1.

As shown in FIG. 5, the extending portion 12 is configured to be hooked to the support 56. Specifically, the extending portion 12 is inserted into the opening of the U-shaped hook of the support 56. Similarly, the additional extending portion 13 is configured to be hooked to the support 56. Specifically, the additional extending portion 13 is inserted into the opening of the U-shaped hook of the support 56. The extending portion 12 and the additional extending portion 13 are made of a bar. The beam portion 14 connects the engaging portion 11 and the extending portion 12. The beam portion 14 is also formed of a bar. The engaging portion 11 and the extending portion 12 are attached to the beam portion 14 by welding, for example. However, the engaging portion 11, the extending portion 12, and the beam portion 14 may be integrally molded by a mold or the like.

As shown in FIGS. 5 and 7-9, the first hose holding member 16 is provided on the beam portion 14. The first additional beam portion 15 is connected to the first hose holding member 16. Specifically, the beam portion 14, the first hose holding member 16, and the first additional beam portion 15 are formed by bending one bar. That is, the beam portion 14, the first hose holding member 16, and the first additional beam portion 15 are integrally formed. The additional extending portion 13 is connected to the first additional beam portion 15. The second hose holding member 18 is provided on the beam portion 14 between the first hose holding member 16 and the extending portion 12. The second hose holding member 18 is also connected to the first additional beam portion 15. Specifically, the extending portion 12, the second hose holding member 18, and the additional extending portion 13 are formed by bending one bar. A bar in which the beam portion 14 and the first additional beam portion 15 are integrated is connected to the bent bar by welding, for example. However, these two bars may be integrally formed by a mold or the like. The second additional beam portion 20 connects the first hose holding member 16 and the second hose holding member 18. Specifically, the second additional beam portion 20 is connected to, for example, the lower end of the first hose holding member 16 and the lower end of the second hose holding member 18 by welding. However, the second additional beam portion 20 and the above-mentioned two bars may be integrally molded by a mold or the like. The second additional beam portion 20 is made of a plate.

The first hose holding member 16 and the second hose holding member 18 are formed of bars bent in a U-shape. As a result, as shown in FIGS. 4 and 7, the first hose holding member 16 has a first opening 17 through which a plurality of hydraulic hoses 72 (hydraulic hose 72*a*, a plurality of additional hydraulic hoses 72*b*) pass. The second hose holding member 18 has a second opening 19 through which a plurality of hydraulic hoses 72 (hydraulic hose 72*a*, a plurality of additional hydraulic hoses 72*b*) pass. The size of the second opening 19 is equal to or larger than the size of the first opening 17. The first hose holding member 16 is configured to hook a plurality of hydraulic hoses 72 in a state that the cabin 5 is rotated by a predetermined angle around a pivot axis $A_{XC}$ and the space below the cabin 5 is accessible from the outside. Thus, the plurality of hydraulic hoses 72 are prevented from deviating downward.

As shown in FIGS. 3 and 4, the hydraulic hose 72*a* and the plurality of additional hydraulic hoses 72*b* are arranged in two or more columns and two or more rows. Specifically, the plurality of hydraulic hoses 72 (hydraulic hose 72*a*, a plurality of additional hydraulic hoses 72*b*) are arranged in three rows and two columns. Therefore, the work vehicle 1 further includes a first focusing member 21 and a second focusing member 25 for bundling the plurality of hydraulic hoses 72. The first focusing member 21 is provided between the hose installation member 10 and the hydraulic pump 7 or the hydraulic actuator in the longitudinal direction of the plurality of hydraulic hoses 72. Therefore, the hydraulic hose 72*a* and the plurality of additional hydraulic hoses 72*b* are bundled at the side opposite to the second opening 19 with respect to the first opening 17. The second focusing member 25 is provided between the hose installation member 10 and the hydraulic control valve 71 in the longitudinal direction of the plurality of hydraulic hoses 72. Therefore, the hydraulic hose 72*a* and the plurality of additional hydraulic hoses 72*b* are bundled on the side opposite to the first opening 17 with respect to the second opening 19.

Figure 10:
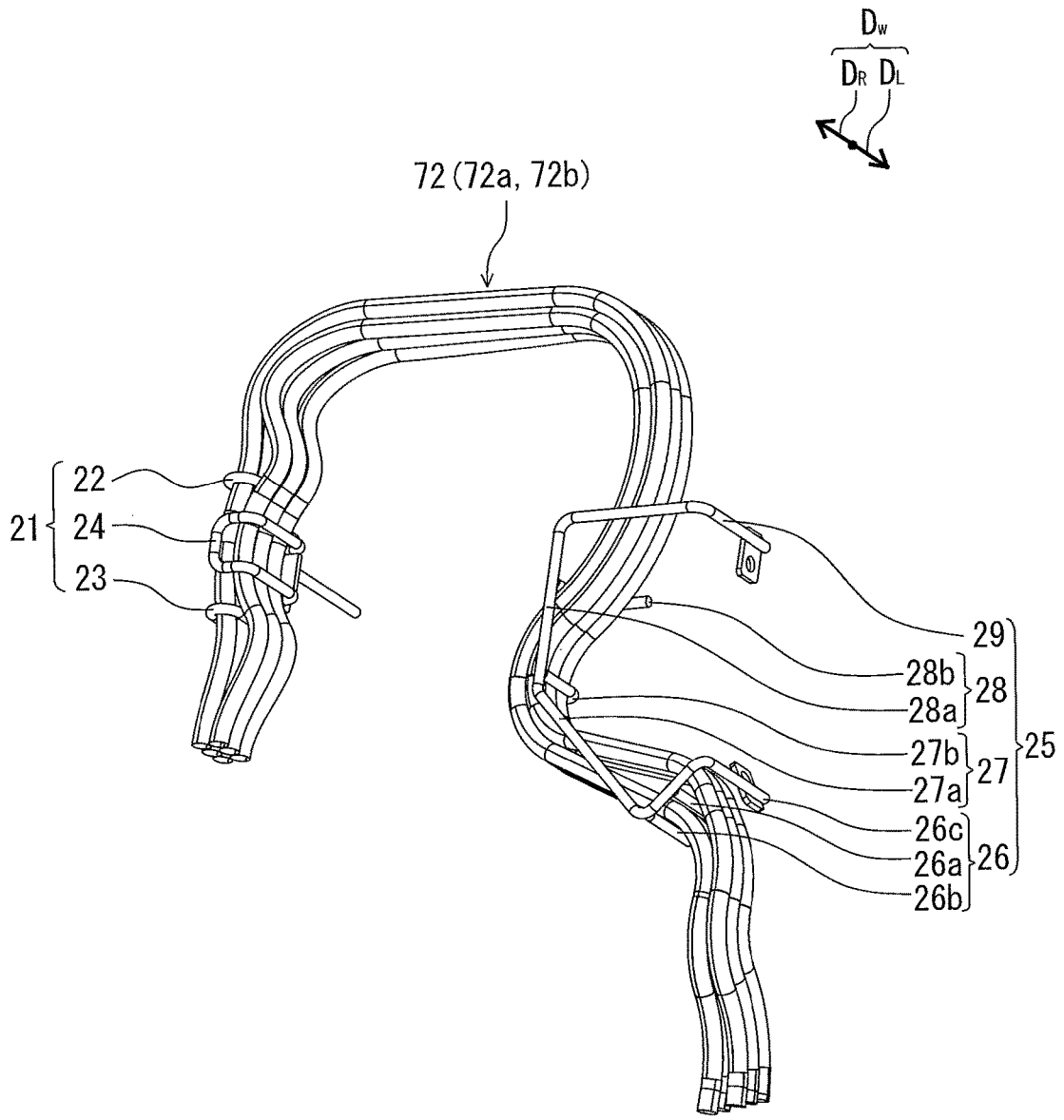
FIG. 10 is an enlarged perspective view showing a plurality of hydraulic hoses, a first focusing member, and a second focusing member.
Figure 11:
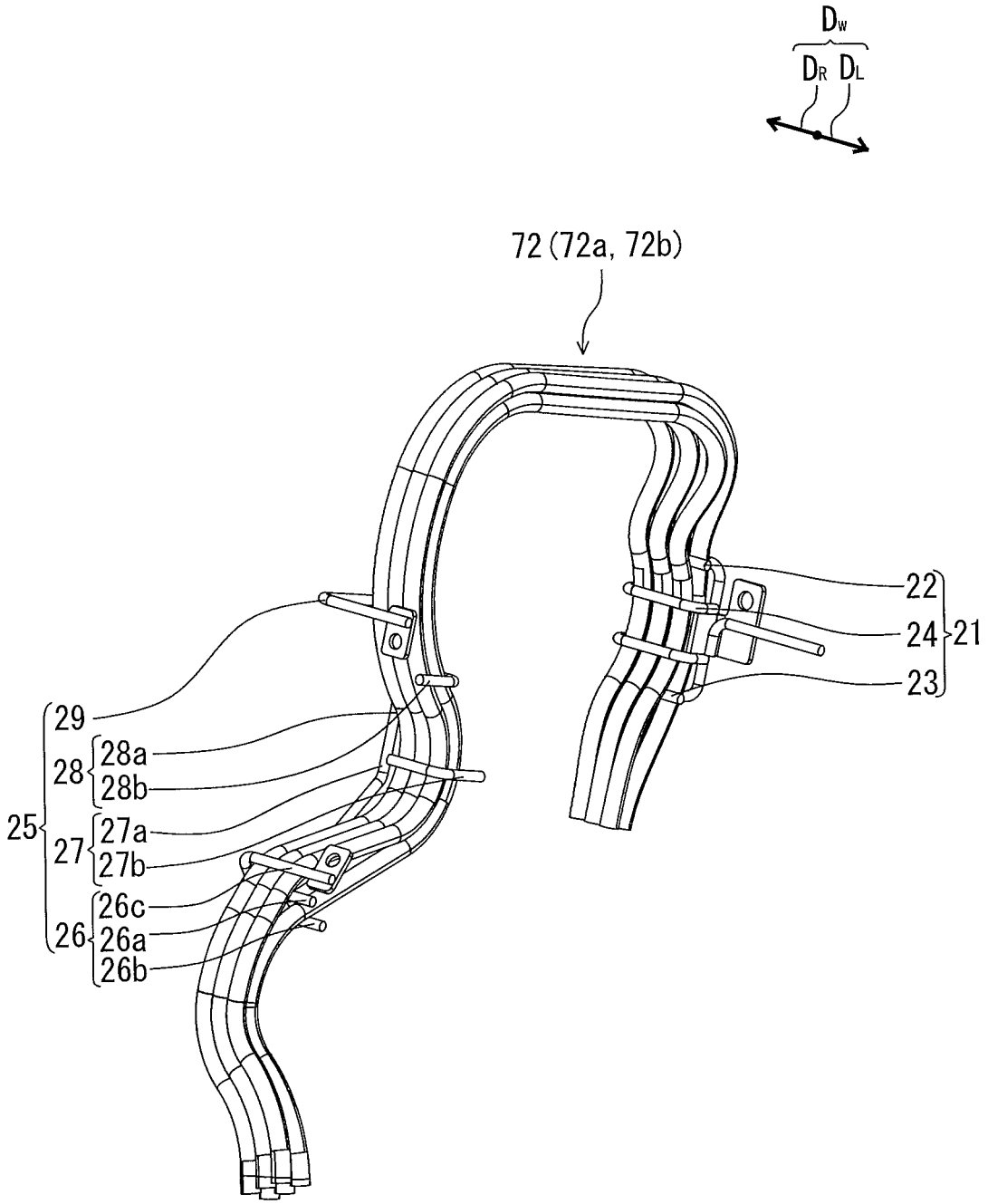
FIG. 11 is an enlarged perspective view showing a plurality of hydraulic hoses, a first focusing member, and a second focusing member.

FIGS. 10 and 11 are enlarged perspective views showing a plurality of hydraulic hoses 72, a first focusing member 21, and a second focusing member 25. In FIGS. 10 and 11, the vehicle body frame 2, the cab frame 53, the hose installation member 10, and the like are not shown. Referring to FIGS. 11 and 12, the first focusing member 21 includes a first column dividing section 22, a second column dividing section 23, and a gathering section 24. The first column dividing section 22, the second column dividing section 23 and the gathering section 24 are formed by bending one bar. The first column dividing section 22 and the second column dividing section 23 divide respective rows of the plurality of hydraulic hoses 72. The gathering section 24 gathers the plurality of hydraulic hoses 72 in one bundle between the first column dividing section 22 and the second column dividing section 23.

The second focusing member 25 includes a third column dividing section 26, a first guide section 27, a second guide section 28, and a third guide section 29. The third column dividing section 26 has a first rod member 26*a*, a second rod member 26*b*, and a third rod member 26*c*, and divides the respective columns of the plurality of hydraulic hoses 72 by holding the hydraulic hoses of one column among the plurality of hydraulic hoses 72 between the first rod member 26*a* and the second rod member 26*b*, and holding the hydraulic hoses of another column among the plurality of hydraulic hoses 72 between the first rod member 26*a* and the third rod member 26*c*. The first guide section 27 has a fourth rod member 27*a* and a fifth rod member 27*b*, and guides the plurality of hydraulic hoses 72 between the fourth rod member 27*a* and the fifth rod member 27*b*. The second guide section 28 has a sixth rod member 28*a* and a seventh rod member 28*b*, and guides the plurality of hydraulic hoses 72 between the sixth rod member 28*a* and the seventh rod member 28*b*. The third guide section 29 guides the plurality of hydraulic hoses 72 to the right side of the third guide section 29. The third rod member 26*c*, the fourth rod member 27*a*, the sixth rod member 28*a*, and the third guide section 29 are formed by bending one bar, and the first rod member 26*a*, the second rod member 26*b*, the fifth rod member 27*b*, and the seventh rod member 28*b* are connected to the bent bar by welding.

The plurality of hydraulic hoses 72 are arranged in two or more columns and two or more rows by the first focusing member 21, the second focusing member 25, etc., so that the curvature change of the plurality of hydraulic hoses 72 can be made substantially equal. Therefore, the slack of the plurality of hydraulic hoses 72 at the time of the rotation of the cabin 5 can be matched.

Operation and Effect of Embodiments

In the present embodiment, the work vehicle 1 includes the vehicle body frame 2, the cab frame 53, the support 56, the fastener 57, the hose installation member 10, and the hydraulic hose 72*a*. The hose installation member 10 includes the engaging portion 11, the extending portion 12, the beam portion 14, and the first hose holding member 16. The first hose holding member 16 has the first opening 17 through which the hydraulic hose 72*a* passes. Thus, the hose installation member 10 to which a plurality of hydraulic hoses 72 are previously attached can be attached to the cab frame 53 instead of passing the hydraulic hose 72*a* through a hose guide attached to the vehicle body frame 2 or the cab frame 53, thereby the installation of the plurality of hydraulic hoses 72 is facilitated. In particular, the pilot hose which becomes longer due to removal of the relay member can be easily installed.

Variations of the Embodiments

In the embodiment described above, the structure of the extending portion 12 and the support 56 may be the same as the structure of the engaging portion 11 and the fastener 57. The configuration of the engaging portion 11 and the fastener 57 may be another removable fixing method other than a bolt. Such a fixing method may be, for example, press-fitting. At least one of the additional extending portion 13, the first additional beam portion 15, the second additional beam portion 20, and the stay 57S may be omitted. One of the first opening 17 and the second opening 19 may be omitted, and the first opening 17 and the second opening 19 may be replaced. The member shown as a round bar in the embodiment may be a square bar member. The position of the engaging portion 11 may be left and right opposite.

As used herein, "comprise" and its derivatives are non-limiting terms that describe the presence of a component and do not exclude the presence of other components that are not described. This also applies to "have", "include" and their derivatives.

The terms " . . . member", " . . . part", " . . . element", " . . . body" and " . . . structure" may have multiple meanings, such as a single part or multiple parts.

Ordinal numbers such as "first" and "second" are terms used only to identify structures and do not have other meanings (for example, in a particular order). For example, the existence of "first element" does not imply the existence of "second element" and the existence of "second element" does not imply the existence of "first element".

Terms such as "substantially", "roughly", and "about", which represent degrees, may mean a reasonable amount of deviation such that the final result does not vary significantly unless otherwise explained in the embodiments. All figures described herein may be interpreted to include phrases such as "substantially", "roughly", "about", and the like.

The phrase "at least one of A and B" in this application should be interpreted to include only A, only B, and both A and B.

It will be apparent from the above disclosure that various modifications and modifications of the present invention are possible. Accordingly, the present invention may be practiced in a manner different from the specific disclosure of the present invention without departing from the spirit and spirit of the invention.

Obviously, numerous modifications and variations of the present invention are possible in light of the above teachings. It is therefore to be understood that within the scope of the appended claims, the invention may be practiced otherwise than as specifically described herein.

What is claimed is:

1. A work vehicle comprising:
- a vehicle body frame;
- a cab frame attached to the vehicle body frame so as to be rotatable around a pivot axis;
- a support provided on the cab frame;
- a fastener provided on the cab frame and between the support and the pivot axis in a radial direction from the pivot axis;
- a hydraulic hose; and
- a hose installation member comprising:
  - an engaging portion connected to the fastener;
  - an extending portion configured to be supported on the support;
  - a beam portion connecting the engaging portion and the extending portion; and
  - a first hose holding member provided on the beam portion and having a first opening through which the hydraulic hose passes,
- wherein the fastener comprises a stay to hook the engaging portion.

2. The work vehicle according to claim 1, wherein the hose installation member comprises a second hose holding member which is provided on the beam portion between the first hose holding member and the extending portion and which has a second opening through which the hydraulic hose passes.

3. The work vehicle according to claim 2, wherein a size of the second opening is equal to or larger than a size of the first opening.

4. The work vehicle according to claim 2, wherein the hose installation member further comprises a first additional beam portion connecting the first hose holding member and the second hose holding member.

5. The work vehicle according to claim 4, wherein the hose installation member further comprises an additional extending portion connected to the first additional beam portion and configured to be supported on the support.

6. The work vehicle according to claim 2, wherein each of the first hose holding member and the second hose holding member comprises a bar having a U-shape.

7. The work vehicle according to claim 6, wherein the hose installation member further comprises a second additional beam portion connecting the first hose holding member and the second hose holding member.

8. The work vehicle according to claim 1, wherein the engaging portion is connected to the fastener via a bolt.

9. The work vehicle according to claim 1, wherein the support comprises a U-shaped hook, and the extending portion is inserted into an opening of the U-shaped hook.

10. The work vehicle according to claim 1, further comprising:
- a plurality of additional hydraulic hoses configured to pass through the first opening and the second opening, wherein the hydraulic hose and the plurality of additional hydraulic hoses are arranged in a plurality of columns and rows.

11. The work vehicle according to claim 10, wherein the hydraulic hose and the plurality of additional hydraulic hoses are bundled on a side opposite to the first opening with respect to the second opening.

12. The work vehicle according to claim 10, wherein the hydraulic hose and the plurality of additional hydraulic hoses are bundled on a side opposite to the second opening with respect to the first opening.

13. The work vehicle according to claim 1, wherein the cab frame is rotatable with respect the vehicle body frame around the pivot axis such that the cab frame is separated from and approaches toward the vehicle body frame.

14. The work vehicle according to claim 1, wherein the cab frame is rotatable with respect the vehicle body frame around the pivot axis such that a space below the cabin frame is accessible from an outside.

15. A work vehicle comprising:
- a vehicle body frame;
- a cab frame attached to the vehicle body frame so as to be rotatable around a pivot axis;
- a support provided on the cab frame;
- a fastener provided on the cab frame and between the support and the pivot axis in a radial direction from the pivot axis;
- a hydraulic hose; and
- a hose installation member comprising:
  - an engaging portion connected to the fastener;
  - an extending portion configured to be supported on the support;
  - a beam portion connecting the engaging portion and the extending portion; and
  - a first hose holding member provided on the beam portion and having a first opening through which the hydraulic hose passes,
- wherein the support comprises a U-shaped hook, and the extending portion is inserted into an opening of the U-shaped hook.

16. The work vehicle according to claim 15, wherein the hose installation member further comprises
- a second hose holding member which is provided on the beam portion between the first hose holding member and the extending portion and which has a second opening through which the hydraulic hose passes, a first additional beam portion connecting the first hose holding member and the second hose holding member, and an additional extending portion connected to the first additional beam portion and configured to be inserted into the opening of the U-shaped hook.

17. The work vehicle according to claim 15, wherein the hose installation member comprises a second hose holding member which is provided on the beam portion between the first hose holding member and the extending portion and which has a second opening through which the hydraulic hose passes.

18. The work vehicle according to claim 17, wherein a size of the second opening is equal to or larger than a size of the first opening.

19. A work vehicle comprising:

a vehicle body frame;

a cab frame attached to the vehicle body frame so as to be rotatable around a pivot axis;

a support provided on the cab frame;

a fastener provided on the cab frame and between the support and the pivot axis in a radial direction from the pivot axis;

a hydraulic hose; and a hose installation member comprising:

an engaging portion connected to the fastener;

an extending portion configured to be supported on the support;

a beam portion connecting the engaging portion and the extending portion;

a first hose holding member provided on the beam portion and having a first opening through which the hydraulic hose passes;

a second hose holding member which is provided on the beam portion between the first hose holding member and the extending portion and which has a second opening through which the hydraulic hose passes;

a first additional beam portion connecting the first hose holding member and the second hose holding member; and an additional extending portion connected to the first additional beam portion and configured to be supported on the support.

20. The work vehicle according to claim 19, wherein the fastener comprises a stay to hook the engaging portion.

* * * * *